United States Patent [19]

Reisman

[11] Patent Number: 4,633,378

[45] Date of Patent: Dec. 30, 1986

[54] DEVICE FOR SUPPORTING LAMP SHADE ON LAMP SOCKET

[75] Inventor: George F. Reisman, Fort Lee, N.J.

[73] Assignee: Charm-Glo Mfg. Co., Inc., Paterson, N.J.

[21] Appl. No.: 759,339

[22] Filed: Jul. 26, 1985

[51] Int. Cl.[4] ..... F21V 17/00

[52] U.S. Cl. ..... 362/353; 362/434; 362/441

[58] Field of Search ..... 362/433, 434, 439, 353, 362/449, 457, 440, 441, 442, 438, 311, 378, 443, 351, 448; D26/118

[56] References Cited

U.S. PATENT DOCUMENTS

| | | | |
|---|---|---|---|
| 141,223 | 7/1873 | House | 362/441 |
| 266,048 | 10/1882 | Petsch | 362/441 |
| 1,247,493 | 11/1917 | Benjamin | 362/443 |
| 1,483,264 | 2/1924 | Anderson | 362/434 |

FOREIGN PATENT DOCUMENTS

| | | | |
|---|---|---|---|
| 25380 | of 1901 | United Kingdom | 362/442 |

*Primary Examiner*—William A. Cuchlinski, Jr.

*Assistant Examiner*—D. M. Cox

*Attorney, Agent, or Firm*—Henry R. Lerner

[57] ABSTRACT

There is disclosed a device for supporting a lamp shade on a variety of lamp sockets of different diameters. The supporting device, also referred to as a lamp shade holder, is constructed with an outer rim adapted to be secured to the lamp shade, an inner rim secured to the outer rim, and two sets of fingers extending from the inner rim and terminating in two different sets of socket engaging ends. One set of socket engaging ends is adapted to engage a first lamp socket having a size falling within a first range of sizes. The other set of socket engaging ends is adapted to engage at least a second lamp socket having a size falling within a second range of sizes which are different from the sizes within the first range. As an additional feature, a plurality of washers of different thicknesses are provided integrally with the lamp shade holder. The washers are detachable so that one or more of these washers can be placed between a lamp socket and lamp of small diameter to prevent the lamp shade from slipping off the socket and over the lamp.

16 Claims, 9 Drawing Figures

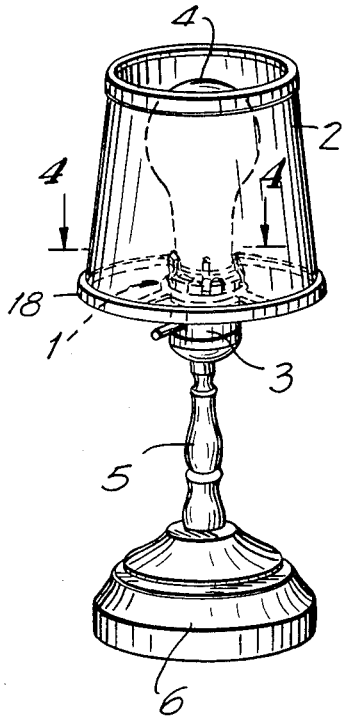
FIG. 1
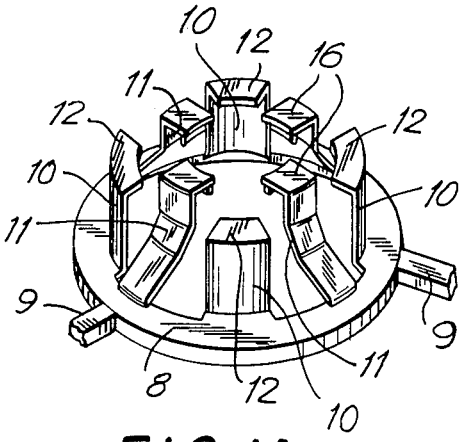
FIG. 1A
FIG. 2
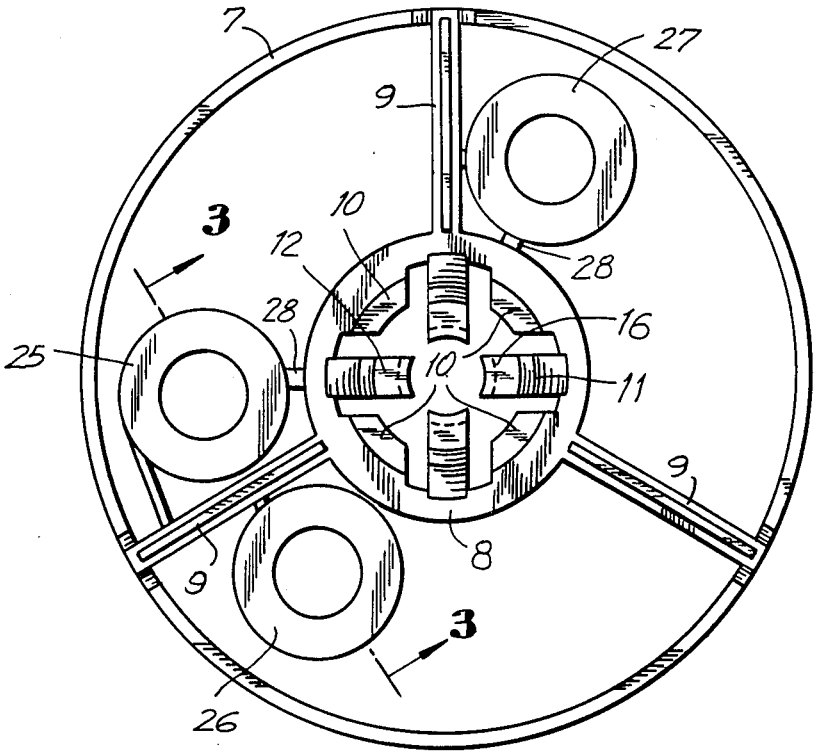
FIG. 3
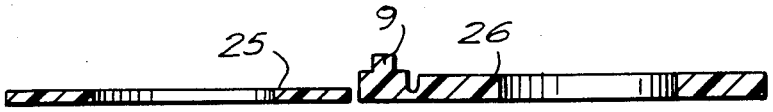

DEVICE FOR SUPPORTING LAMP SHADE ON LAMP SOCKET

BACKGROUND OF THE INVENTION

The present invention relates to lamp shade holders for supporting a lamp shade on a lamp socket.

Lamps come in a wide variety of different sizes and shapes. Ever since the advent of lamp shades to shield the eyes from the harsh glow of a lamp and diffuse the light, there has existed the need for a device to secure the lamp shade around the lamp.

A great variety of lamp shade holders have been developed. Some holders are secured directly to the lamp. This presents the awkward necessity of having to remove the lamp shade and holder to replace a burned-out lamp. Other lamp shade holders are secured to the lamp socket facilitating the changing of a burned-out lamp. However, since lamps, and hence lamp sockets, vary greatly in size and shape, a lamp shade holder designed for a specific lamp or lamp socket is limited in use to lamps and sockets of that particular size. For example, there is a significant difference in size between the standard Edison lamp and socket and the candelabra-type lamp and socket. A lamp shade holder designed for an Edison socket would be useless with a candelabra-type socket and vice versa.

There have been attempts to design lamp shade holders which are adaptable to a variety of lamps and lamp sockets. Thus, various adjustable collars and adapters have been designed to render a lamp shade and holder usable with lamps and lamp sockets having different sizes. These collars and adapters are cumbersome and awkward, due to the necessity for manual adjustment and extra parts, which are often lost or misplaced.

Accordingly, it would be desirable to have a lamp shade holder which permitted use of a lamp shade with a number of different size lamps and sockets, yet which did not require extraneous adapters or manual mechanical adjustment.

SUMMARY OF THE INVENTION

An object of the present invention is to eliminate the need for different lamp shade holders when changing a lamp shade from one size lamp to another.

A further object of the present invention is to provide a unitary lamp shade holder for supporting a lamp shade on a variety of lamp sockets of different sizes.

Yet another object of the present invention is to provide a lamp shade holder for supporting a lamp shade on a variety of lamp sockets of different sizes which does not require manual mechanical adjustment, adapters, or the like.

These and other objects are achieved in accordance with the present invention by a device for supporting a lamp shade on a lamp socket constructed with an outer rim adapted to be secured to the lamp shade, an inner rim secured to the outer rim, a first set of fingers extending from the inner rim and terminating in a first set of socket engaging ends, and a second set of fingers extending from the inner rim and terminating in a second set of socket engaging ends, wherein the first set of socket engaging ends is adapted to engage a first lamp socket whose size falls within a first range of sizes and the second set of socket engaging ends is adapted to engage at least a second lamp socket whose size falls within a second range of sizes which is different from the first range of sizes.

Preferably, the second set of fingers and socket engaging ends is resilient and designed for engagement with a smaller socket than the first set of fingers and socket engaging ends. Thus, when the device is mounted on the first, or larger, lamp socket, the resilient second set of fingers and socket engaging ends are pushed out of the way by the socket to facilitate the threading of the larger lamp into the socket.

In the preferred embodiment there are provided detachable washers integrally with the supporting device for optional use between the device and a small lamp, such as a candelabra-type lamp, to prevent the device from slipping off the socket and over the lamp.

BRIEF DESCRIPTION OF THE DRAWINGS

The present invention will now be described with reference to the accompanying drawings, in which:

FIG. 1 is a front perspective view of the lamp shade holder of the present invention in use with a standard Edison lamp and socket;

FIG. 1A is a fragmentary perspective view of a portion of the lamp shade holder of the present invention showing the two sets of socket engaging fingers;

FIG. 2 is a plan view of the lamp shade holder according to the present invention;

FIG. 3 is a cross-sectional view taken along the line 3—3 of FIG. 2;

DETAILED DESCRIPTION OF THE PREFERRED EMBODIMENTS

Figure 4:
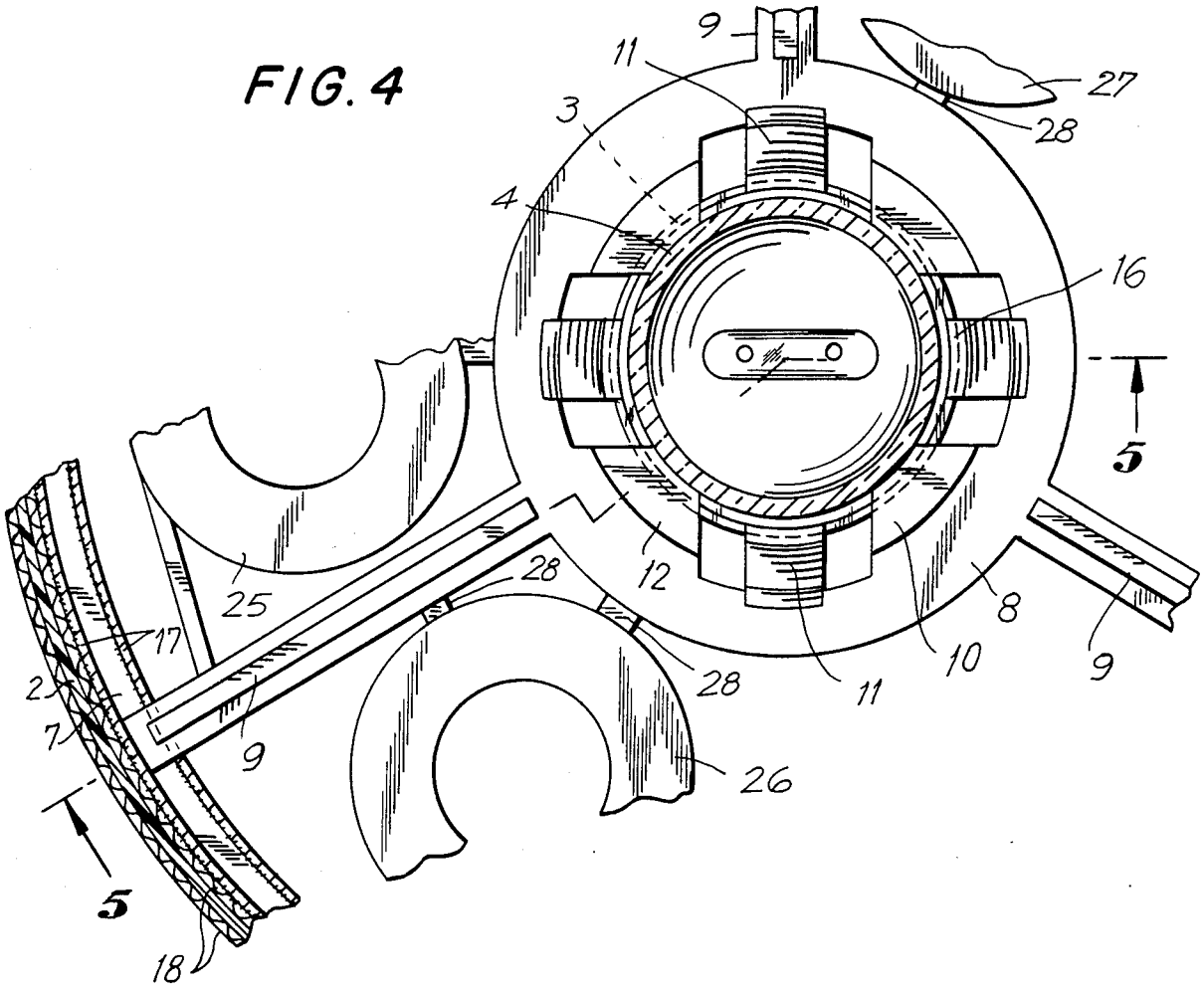
FIG. 4 is a fragmentary view taken along the line 4—4 of FIG. 1, on an enlarged scale.

As shown in FIG. 1, the lamp shade holder 1 of the present invention supports a lamp shade 2 on a lamp socket 3 for an incandescent Edison lamp 4. The lamp socket 3 is mounted in conventional fashion on a lamp pedestal 5 connected to a lamp base 6.

The lamp shade holder 1 of the present invention is best described by reference to FIGS. 1A through 5. As shown therein, an outer circular rim 7 is connected to an inner circular rim 8 through ribs 9. Two sets of resilient fingers 10 and 11, each set containing four fingers, extend from inner rim 8 of lamp shade holder 1 and are integrally connected to inner rim 8 in alternating fashion around the periphery thereof.

Figure 5:
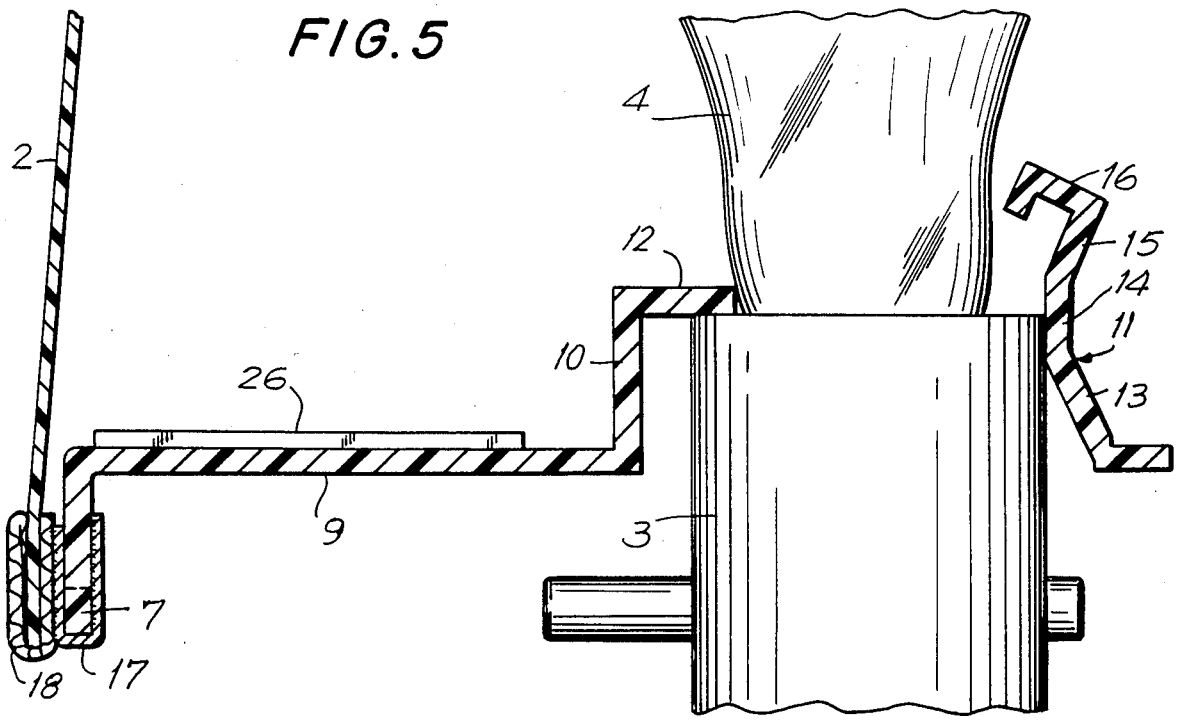
FIG. 5 is a cross-sectional view taken along the line 5—5 of FIG. 4.

Each finger 10 is L-shaped and has a free end 12 adapted to engage lamp socket 3 and rest firmly thereon, as shown in FIG. 5. Each finger 11 is composed of angled portions 13, 14, 15, and terminates in a flange 16 extending more inwardly than free end 12 of finger 10, and thus adapted to engage the smaller candelabra-type lamp socket, as shown in FIG. 8 and as described more fully hereinafter.

The outer rim 7 of lamp shade holder 1 is secured to lamp shade 2 in any conventional manner. As shown in FIG. 5, outer rim 7 is secured in a U-shaped channel 17 connected to lower lip 18 of lamp shade 2.

To use the lamp shade holder 1 with the Edison lamp 4 of FIG. 1, lamp 4 is removed from socket 3 and the lamp shade holder 1, with lamp shade 2 preferably mounted thereon, is held above and then moved downwardly with inner rim 8 surrounding socket 3. As lamp shade holder 1 is moved downwardly over socket 3, (FIG. 5) angled portions 13 and 14 of resilient fingers 11 come into abutment with the outer surface of socket 3. Since fingers 11 are resilient, they are pushed away from socket 3 by the force of the socket 3 against portions 13 and 14. As fingers 11 are pushed outwardly away from socket 3, free ends 12 of fingers 10 come to engage and rest upon socket 3, with the resiliency of fingers 10 aiding the security of the engagements. Lamp 4 is thereafter threaded into socket 3 and the lamp shade 2 with holder 1 is mounted in place. As best seen in FIG. 5, the threading of Edison lamp 4 wedges socket engaging ends 12 of fingers 10 in place to prevent the unintended removal of holder 1 from the socket 3.

Figure 6:
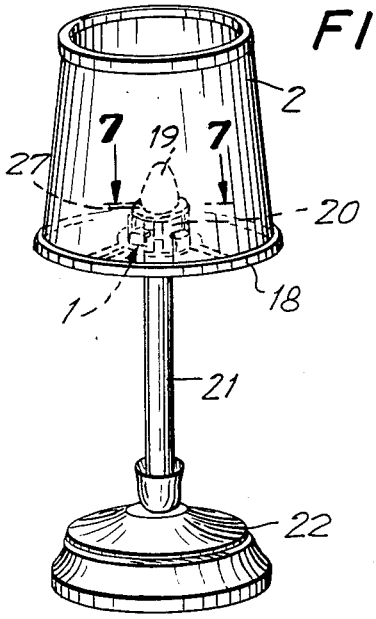
FIG. 6 is a front perspective view of the lamp shade holder of the present invention in use with a candelabra-type lamp and socket.
Figure 7:
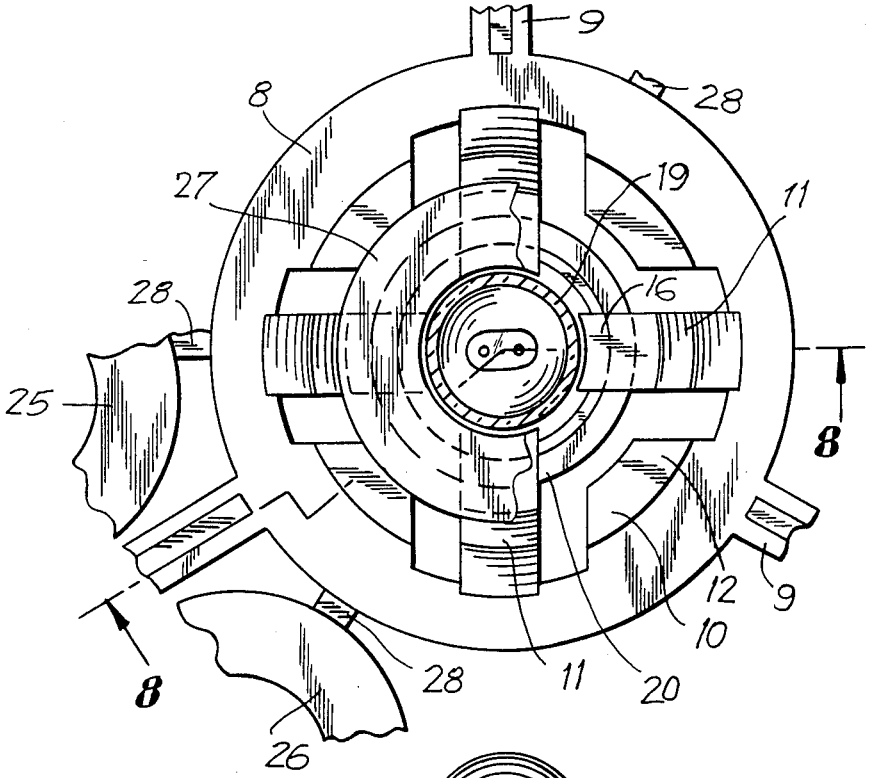
FIG. 7 is a fragmentary view taken along the line 7—7 of FIG. 6, on an enlarged scale.
Figure 8:
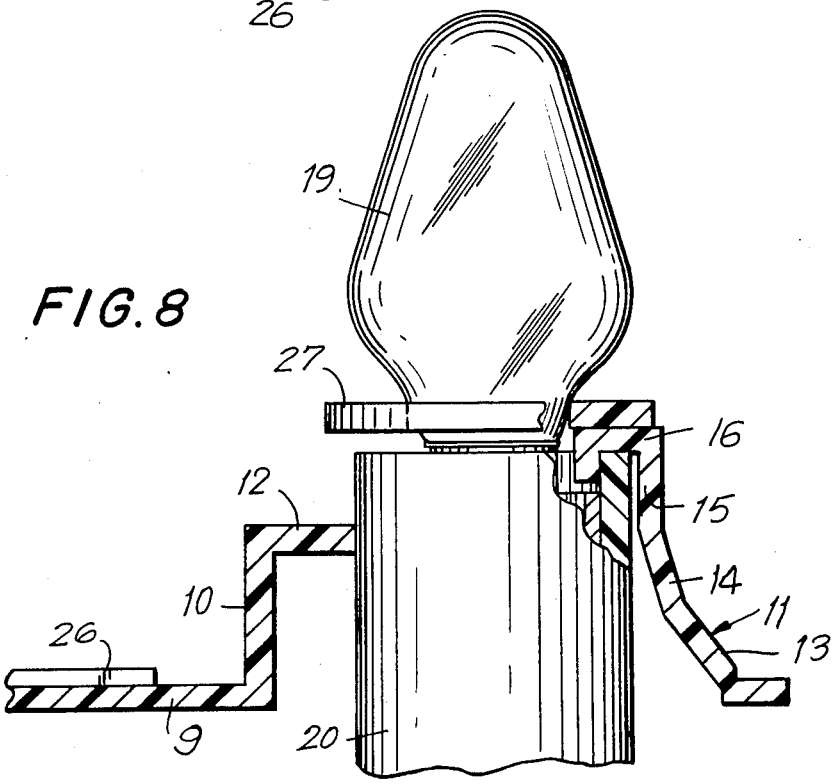
FIG. 8 is a cross-sectional view taken along the line 8—8 of FIG. 7, on an enlarged scale.

In accordance with a principal feature of the invention, lamp shade holder 1 can also be used to support lamp shade 2 on a candelabra-type lamp socket which is substantially smaller than an Edison lamp socket, such being shown in FIGS. 6–8. As best seen in FIG. 6, a candelabra-type lamp 19 is threaded into a candelabra lamp socket 20 mounted in conventional fashion on a lamp pedestal 21 connected to a lamp base 22. The same lamp shade holder 1 supports lamp shade 2 on socket 20.

To mount the lamp shade 2 and holder 1, lamp 19 is removed from socket 20 and the lamp shade holder 1 is held above socket 20 with inner rim 8 surrounding the socket. As lamp shade holder 1 is moved downwardly over socket 20, flanges 16 of resilient fingers 11 engage socket 20 securing the lamp shade 2 and holder 1 thereto. Since fingers 10 are adapted for a larger socket, such as the Edison socket 3 of FIG. 1, they do not interfere with the mounting of the shade and holder on smaller sockets such as candelabra socket 20 and free ends 12 of fingers 10 are resiliently urged against the side of socket 20 to enhance engagement therewith, or simply terminate in spaced relation with the socket. The lamp 19 is threaded onto socket 20 and the lamp shade 2 and holder 1 are mounted in place.

Since the shapes of smaller size lamps vary considerably, the lamp shade holder 1 is not always secured by merely attaching it to the socket and threading the lamp therein. In fact, certain lamps are sufficiently narrow so that the lamp shade holder 1 can easily be slipped over the lamp after the holder 1 has been mounted on the socket and the lamp threaded into the socket. This problem arises with some shades of candelabra-type lamps but does not exist with the Edison lamp.

Accordingly, to prevent lamp shade holder 1 from slipping up over a small irregularly-shaped lamp after mounting, the present invention utilizes washers 25, 26, 27 which may be molded integrally with lamp shade holder 1, but are easily detachable therefrom, as by snipping with a scissors at 28. The washers can all be of the same thickness, but preferably, and as shown in FIG. 3, their thicknesses vary. One or more of washers 25, 26, 27 can be detached from holder 1 and placed centrally on holder 1 after mounting on the lamp socket, as shown in FIGS. 6 to 8. The small size lamp is then threaded into the socket.

Washers 25, 26, 27 play a dual function. First and foremost, they lock and hold the lamp shade and lamp shade holder when secured to the socket and prevent the holder from slipping up over the lamp. Secondly, they maintain the lamp shade in level position. One or more washers are used, singly or in combination, as may be needed, depending on the shape of the lamp.

Although the lamp shade holder of the present invention has been illustrated with two sets of four fingers each, the number of fingers in each set is not critical, as long as the total number of fingers of each set provide stability for the holder 1 and lamp shade when mounted on a lamp socket. Thus, for example, the lamp socket holder of the present invention may be provided with two sets of fingers, each set of fingers being composed of three fingers, or five fingers.

In the lamp shade holder of the present invention, the set of resilient fingers 10 is adapted for engagement with a first lamp socket whose size falls within a first range of sizes and the second set of resilient fingers 11 is adapted for engagement with a second lamp socket whose size falls within a second range of sizes which are smaller than the sizes within said first range. Accordingly, a lamp shade holder is provided which is adaptable to a variety of lamp sockets of different sizes, without requiring the use of a different lamp shade or lamp shade holder. Further, the two ranges may be slightly overlapping so as to accommodate all socket sizes from the smallest in the second range to the largest in the first range.

The thickness of washers 25, 26, 27 is not critical. Accordingly, washers 25, 26, 27 may be provided in a plurality of different thicknesses or all be of the same thickness. Nor is the number of washers critical. More or less than three may be provided, as practical. A greater number of washers provides greater flexibility in diverse situations. The washers are used singly or in combination, depending on the shape of the lamp.

Although the outer rim 7 of lamp shade holder 1 of the present invention is exemplified as secured to the lamp shade 2 by means of U-shaped channel 17, other means of securing the rim 7 to lamp shade 2 may be employed. For example, the rim 7 may be glued or taped to lower lip 18 of lamp shade 2. Additionally, the outer rim 7 may be removably secured to the lamp shade 2, for example with Velcro, thus facilitating interchangeability of one lamp shade for another using the same lamp shade holder.

The lamp shade holder of the present invention is preferably made through conventional plastic molding techniques to provide a unitary, integral structure.

The present invention thus provides a lamp shade and lamp shade holder which is adaptable to a variety of lamps and sockets of different sizes and diameters by means of a unitary integral lamp shade holder which does not require extraneous adapters or any manual mechanical adjustment.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of the invention within the scope of the appended claims.

Having thus described my invention, what I claim and desire to secure by Letters Patent is:

1. A device for supporting a lamp shade on a lamp socket comprising, (1) an outer rim adapted to be secured to the lamp shade, (2) an inner rim secured to the outer rim, (3) a first set of fingers extending from the inner rim and terminating in a first set of socket engaging end means, (4) a second set of fingers extending from the inner rim and terminating in a second set of socket engaging end means, and (5) the first set of socket engaging end means for engaging a first lamp socket of a size falling within a first range of sizes and the second set of socket engaging end means for engaging at least a second lamp socket of a size falling within a second range of sizes which is different from said first range.

2. A device as set forth in claim 1, wherein the first and second set of fingers are resilient.

3. A device as set forth in claim 1, wherein the device is an integral molded device.

4. A device as set forth in claim 1, wherein the first range of sizes is larger than the second range of sizes.

5. A device as set forth in claim 1, wherein the first set of socket engaging end means is for engaging an Edison lamp socket and the second set of socket engaging end means is for engaging at least a candelabra lamp socket.

6. A device as set forth in claim 1, further including washer means for placement between the lamp socket and lamp to prevent the device from slipping over the lamp.

7. A device as set forth in claim 6, wherein the washer means is integrally molded between said inner and outer rims before use.

8. A device in accordance with claim 1, whrein said second set of socket engaging end means extend more inwardly than said first set of socket engaging end means.

9. A device in accordance with claim 1, wherein said first set of fingers comprises four fingers and said second set of fingers comprises four fingers alternately disposed between said first mentioned four fingers.

10. A device in accordance with claim 9, wherein the first set of socket engaging end means is for engaging an Edison lamp socket and the second set of socket engaging end means is for engaging at least a candelabra lamp socket.

11. A device in accordance with claim 10, wherein said second set of socket engaging end means are displaced radially outwardly by said Edison lamp socket when the first set of socket engaging end means engage said Edison lamp socket.

12. An attachment for a lamp socket comprising, (1) a lamp shade; and (2) a device for supporting the lamp shade on the lamp socket, the devive comprising (a) an outer rim secured to the lamp shade;

(b) an inner rim secured to the outer rim;

(c) a first set of fingers extending from the inner rim and terminating in a first set of socket engaging end means;

(d) a second set of fingers extending from the inner rim and terminating in a second set of socket engaging end means, and (e) the first set of socket engaging end means for engaging a first lamp socket of a size falling within a first range of sizes and the second set of socket engaging end means for engaging at least a second lamp socket of a size falling within a range of sizes which is different from said first range.

13. An attachment as set forth in claim 12, wherein the outer rim is secured to a lower lip of the lamp shade.

14. An attachment as set forth in claim 12, wherein the first and second set of fingers are resilient.

15. An attachment as set forth in claim 12, wherein the first range of sizes is larger than the second range of sizes.

16. An attachment as set forth in claim 12, wherein the first set of socket engaging end means is for engaging an Edison lamp socket and the second set of socket engaging end means is for engaging at least a candelabra lamp socket.

* * * * *